US005710115A

United States Patent [19]

Patel et al.

[11] Patent Number: 5,710,115

[45] Date of Patent: Jan. 20, 1998

[54] AUTOMATIC DISHWASHING COMPOSITION CONTAINING PARTICLES OF DIACYL PEROXIDES

[75] Inventors: Rashesh Naresh Patel, West Chester; Edward Paul Fitch V, Cincinnati; Jeffrey Donald Painter, Loveland; Alan Scott Goldstein, Blue Ash, all of Ohio

[73] Assignee: The Procter & Gamble Company, Cincinnati, Ohio

[21] Appl. No.: 713,043

[22] Filed: Sep. 11, 1996

Related U.S. Application Data

[63] Continuation of Ser. No. 352,468, Dec. 9, 1994, abandoned.

[51] Int. Cl.[6] ..... C11D 3/395

[52] U.S. Cl. ..... 510/224; 510/220; 510/226; 510/230

[58] Field of Search ..... 510/220, 224, 510/226, 230

[56] References Cited

U.S. PATENT DOCUMENTS

| | | | |
|---|---|---|---|
| 2,955,905 | 10/1960 | Davies et al. . | |
| 3,606,990 | 9/1971 | Courbevoie et al. | 8/11 |
| 3,634,266 | 1/1972 | Theile et al. | 252/232 |
| 4,021,360 | 5/1977 | McLaughlin et al. | 252/99 |
| 4,025,453 | 5/1977 | Kravetz et al. | 252/102 |
| 4,033,894 | 7/1977 | McLaughin et al. | 252/99 |
| 4,086,175 | 4/1978 | Kravetz et al. | 252/99 |
| 4,086,177 | 4/1978 | Kubitscheck et al. | 252/102 |
| 4,092,258 | 5/1978 | McLaughin et al. | 252/99 |
| 4,100,095 | 7/1978 | Hutchins et al. | 252/99 |
| 4,387,044 | 6/1983 | Sanchez et al. | 252/426 |
| 4,444,674 | 4/1984 | Gray | 252/95 |
| 4,530,766 | 7/1985 | Hann et al. | 210/701 |
| 4,547,305 | 10/1985 | Cornelissen et al. | 252/94 |
| 4,568,476 | 2/1986 | Kielman et al. | 252/95 |
| 4,655,953 | 4/1987 | Oakes | 252/99 |
| 4,720,353 | 1/1988 | Bell | 252/309 |
| 4,988,363 | 1/1991 | Barnes | 252/100 |
| 5,089,162 | 2/1992 | Rapisarda et al. | 252/102 |
| 5,130,044 | 7/1992 | Mitchell et al. | 252/102 |
| 5,130,045 | 7/1992 | Mitchell et al. | 252/102 |
| 5,173,207 | 12/1992 | Drapier et al. | 252/99 |
| 5,213,706 | 5/1993 | Rapisarda et al. | 252/135 |
| 5,246,612 | 9/1993 | Van Dijk et al. | 252/102 |
| 5,258,132 | 11/1993 | Kamel et al. | 252/94 |
| 5,314,639 | 5/1994 | Torenbeek | 252/186.23 |
| 5,338,474 | 8/1994 | Kaiserman et al. | 252/95 |

FOREIGN PATENT DOCUMENTS

| | | | |
|---|---|---|---|
| 0 239 379 A2 | 3/1987 | European Pat. Off. | C11D 3/386 |
| 0 295 093 A1 | 6/1988 | European Pat. Off. | C11D 3/395 |
| 0 337 535 A2 | 3/1989 | European Pat. Off. | C11D 3/39 |
| 0 504 091 A1 | 3/1992 | European Pat. Off. | C11D 3/00 |
| 0 516 553 A2 | 5/1992 | European Pat. Off. | C11D 3/386 |
| 0619366 A1 | 10/1994 | European Pat. Off. | C11D 17/00 |
| 2311089 | 12/1976 | France | C11D 3/39 |
| 1022893 | 9/1965 | United Kingdom . | |
| 1 293 063 | 10/1972 | United Kingdom | C11D 7/54 |
| 2285629 | 7/1995 | United Kingdom | C11D 7/38 |
| 95/33817 | 12/1995 | WIPO | C11D 17/00 |

OTHER PUBLICATIONS

"Peroxides and Peroxy Compounds, Organic".

"The Stability of a Benzoyl Peroxide Acne Cream Product" published in the Canadian Journal of Pharmaceutical Sciences, Dec. 1967.

U.S. application No. 08/263,165, Painter, filed Dec. 16, 1991.

U.S. application No. 08/052,850, Raleigh et al., filed Arp. 26, 1993.

U.S. application No. 08/172,627, Sadlowski, filed Dec. 23, 1993.

U.S. application No. 08/172,630, Sadlowski, filed Dec. 23, 1993.

U.S. application No. 08/106,022, Burckett–St. Laurent, Aug. 13, 1993.

U.S. application No. 08/147,224, Sadlowski, filed Nov. 3, 1993.

U.S. application No. 08/147,219, Sadlowski, filed Nov. 3, 1993.

U.S. application No. 08/226,929, Taylor et al., filed Apr. 13, 1994.

*Primary Examiner*—Helane Myers
*Assistant Examiner*—Alexander G. Ghyka
*Attorney, Agent, or Firm*—B. M. Bolam; K. W. Zerby; R. S. Echler, Sr.

[57] ABSTRACT

Automatic dishwashing detergent compositions comprising a diacyl peroxide particle are disclosed. The diacyl peroxide particles preferably comprise diacyl peroxide and a stabilizing additive in which the diacyl peroxide does not dissolve. The stabilizing additive is selected from the group consisting of inorganic salts, transition metal chelants, antioxidants, binding agents, coating agents, and mixtures thereof. The compositions are effective in removing stains from plastics under various temperature and pH conditions.

8 Claims, No Drawings

AUTOMATIC DISHWASHING COMPOSITION CONTAINING PARTICLES OF DIACYL PEROXIDES

This is a continuation of application Ser. No. 08/352,468, filed on Dec. 9, 1994 now abandoned.

TECHNICAL FIELD

The present invention is in the field of automatic dishwashing detergents. More specifically, the invention relates to granular automatic dishwashing detergents which provide enhanced cleaning, e.g. improved stain removal on plastics. The automatic dishwashing compositions comprise adding a diacyl peroxide which has been stabilized by forming particles of the peroxide with a stabilizing additive.

BACKGROUND OF THE INVENTION

Automatic dishwashing detergents (hereinafter ADDs) used for washing tableware (i.e. glassware, china, silverware, pots and pans, plastic, etc.) in the home or institutionally in machines especially designed for the purpose have long been known. Dishwashing in the seventies is reviewed by Mizuno in Vol. 5, Part III of the Surfactant Science Series, Ed. W. G. Cutler and R. C. Davis, Marcel Dekker, N.Y., 1973, incorporated by reference. The particular requirements of cleansing tableware and leaving it in a sanitary, essentially spotless, residue-free state has indeed resulted in so many particular ADD compositions that the body of art pertaining thereto is now recognized as quite distinct from other cleansing product art.

In light of legislation and current environmental trends, modem ADD products desirably contain low levels or are substantially free of inorganic phosphate builder salts and/or are concentrated formulations (i.e. ½ cup vs. full cup usage). Unfortunately, nonphosphated ADD products in technical terms may sacrifice efficacy, especially owing to the deletion of phosphate and, in some instances, chlorine mainstay cleansing ingredients. Concentrated or compact compositions similarly exhibit formulation problems.

Users of ADDs have come to expect tableware will be rendered essentially spotless and film-free in addition to cleaning. In practice, this means avoiding film-forming components. The formulator will generally employ ingredients which are sufficiently soluble that residues or build-up do not occur. Again, while some ingredients may be adequate on grounds of cleaning, spotting and filming, solubility considerations may dish their usefulness. Solubility considerations are even more acute with the newer "low usage", "concentrated", ADD compositions whose overall solubility can be less than that of conventional ("full cup") products.

It has generally been believed by the formulator of ADDs that inexpensive cleaning can be achieved via high alkalinity and/or high silicate levels (for example as provided by formulations comprising high percentages by weight of sodium hydroxide, silicate or metasilicate). Severe penalties can result in these compositions in terms of product corrosiveness to dishwashers and tableware, especially china and glassware and incompatibility with other detergent ingredients. It is therefore highly desirable, at least in some phosphate-free compact ADDs, to achieve good cleaning end-results without resorting to the use of high alkalinity/high silicate.

Chlorine and peroxygen bleaches are effective for stain and/or soil removal. Chlorine bleaches while effective cleaners are often not compatible with other detergent ingredients and/or require additional processing. Peroxygen bleaches on the other hand are less reactive, but such bleaches are temperature and/or pH dependent. As a consequence, there has been a substantial amount of research to develop bleaching systems which contain an activator that renders peroxygen bleaches effective in various wash liquor conditions. Also the conventional chlorine bleaches and peroxygen bleaches, i.e. perborate and percarbonate, have not been found to be effective in removing stains from plastics.

Another source of bleaching are the diacyl peroxides (DAPs). Although diacyl peroxides have been disclosed for use in the laundry and anti-acne area, they have not been employed in the ADD area. In the laundry field certain diacyl peroxides have been found to be effective in the removal of tea stains from fibrous material. In a dishwashing context however these diacyl peroxides have been found to be less effective than perborate and percarbonate on tea stain removal. Further, as discussed above, solubility of diacyl peroxides has been a concern in the laundry field as well.

It has been surprisingly discovered that DAPs can improve the stain removal performance (including dye transfer) of ADDs on plastics.

By the present invention, it has also been unexpectedly discovered that water-insoluble forms of DAP must be used to obtain the plastic stain removal performance.

Further, it has been surprisingly found that the water-insoluble diacyl peroxides do not adversely react with chlorine bleach. Thus, diacyl peroxides provide an additional dimension of stain removal not obtained with chlorine bleach alone.

The novel ADDs have the property of removing a wide variety of stains, including tea stain, fruit juice and carotenoid objected to by the consumer from plastic dishware. The compositions have other cleaning and spotlessness advantages such as enhanced glass care (i.e. reduction of cloudiness and iridescence negatives) and reduction of silicate/carbonate deposition filming negatives.

SUMMARY OF THE INVENTION

The present invention encompasses automatic dishwashing detergent compositions, especially granular or powder-form automatic dishwashing detergent compositions which comprise by weight of the composition from about 0.1% to about 20% of a water in soluble diacyl peroxide, said diacyl peroxide having been added as a diacyl peroxide particle to the composition, said particle comprising, by weight of said particle, from about 1% to about 80%, preferably from about 5% to about 40% water-insoluble diacyl peroxide having the general formula:

RC(O)OO(O)CR1 wherein R and R1 can be the same or different, preferably no more than one is a hydrocarbyl chain of longer than ten carbon atoms, more preferably at least one has an aromatic nucleus and from about 0.01% to about 95%, preferably from about 40% to about 95% stabilizing additive in which said diacyl peroxide does not dissolve, said stabilizing additive is selected from the group consisting of inorganic salts, transition metal chelants, antioxidants, binding agents, coating agents and mixtures thereof.

While diacyl peroxide particulates comprising water-insoluble diacyl peroxide and stabilizing additive are the essential ingredients to the present invention, there are also provided embodiments wherein additional components, especially, bleaching agent, silicate, enzymes, detergency builder and/or detergency surfactant are desirably present. Highly preferred embodiments of the invention contain dibenzoyl peroxide.

The present invention also encompasses a method for cleaning soiled tableware comprising contacting said tableware with an aqueous medium having a pH in the range from about 8 to about 13, more preferably from about 9 to about 12, and comprising at least from about 0.01% to about 8% of a diacyl peroxide selected from the group consisting of dibenzoyl peroxide, benzoyl glutaryl peroxide, benzoyl succinyl peroxide, di-(2-methybenzoyl) peroxide, diphthaloyl peroxide and mixtures thereof. The essential diacyl peroxide is added in a particulate form preferably with a stabilizing agent selected from the group consisting of inorganic salt, binding agent, coating agent and/or chelant.

DETAILED DESCRIPTION OF THE INVENTION

An automatic dishwashing detergent composition comprising by weight: of the composition from about 0.01% to about 20% of a water-insoluble diacyl peroxide, said diacyl peroxide being added as a particulate comprising, by weight of said particulate, from about 1% to about 80% of a water-insoluble diacyl peroxide having the general formula:

$$RC(O)OO(O)CR^1$$

wherein R and $R^1$ can be the same or different, preferably no more than one is a hydrocarbyl chain of longer than ten carbon atoms, more preferably at least one has an aromatic nucleus and from about 0.01%% to about 95% stabilizing additive in which said diacyl peroxide does not dissolve, said stabilizing additive is selected from the group consisting of inorganic salts, antioxidants, binding agents, coating agents, chelants and mixtures thereof.

A particularly preferred embodiment contains dibenzoyl peroxide as the water-insoluble diacyl peroxide.

The term "diacyl peroxide does not dissolve" is defined herein to mean the diacyl peroxide does not dissolve in the stabilizing additive(s) under particle processing conditions and/or ADD product storage conditions.

The term "wash solution" is defined herein to mean an aqueous solution of the product dissolved at 1,000–6,000 ppm, preferably at 2,500–4,500 ppm, in an automatic dishwasher.

The term "water-insoluble" is defined herein to mean limited water solubility, i.e. less than 1%, preferably less than 0.5%, dissolves in water.

The term "stabilizing additive" is defined herein to mean a compound or compounds that prevents the diacyl peroxide from decomposing with other ingredients, especially components in which the diacyl peroxide is soluble in and with which the diacyl peroxide will react while stored in the product.

Diacyl Peroxide Bleaching Species

The ADD composition of the present invention contain from about 0.01% to about 20%, preferably from about 0.1% to about 10%, more preferably from about 0.2% to about 2% water-insoluble diacyl peroxide of the general formula:

$$RC(O)OO(O)CR^1$$

wherein R and $R^1$ can be the same or different, preferably no more than one is a hydrocarbyl chain of longer than ten carbon atoms, more preferably at least one has an aromatic nucleus.

Examples of suitable diacyl peroxides are selected from the group consisting of dibenzoyl peroxide, benzoyl glutaryl peroxide, benzoyl succinyl peroxide, di-(2-methybenzoyl) peroxide, diphthaloyl peroxide and mixtures thereof, more preferably dibenzoyl peroxide, diphthaloyl peroxides and mixtures thereof. The preferred diacyl peroxide is dibenzoyl peroxide.

Without being bound by theory, it is believed that the free radical formed upon the decomposition of the diacyl peroxide is essential in plastic stain removal. Therefore the diacyl peroxide must thermally decompose in wash conditions (i.e. from about 100° F. to about 160° F.) to form free radicals.

Particle size can also play an important role in the performance of the diacyl peroxide in an ADD product. The mean particle size as measured by a laser particle size analyzer (e.g. Malvern) on an agitated mixture with water of the diacyl peroxide is preferably less than about 300 μm, more preferably less than about 150 μm. Although water insolubility is an essential characteristic of the diacyl peroxide of the present invention, the particle size is important for controlling residue formation in wash.

Stabilizing Additive

To provide the necessary storage stability it is essential to incorporate the diacyl peroxides in a particle compatible with an ADD formulation. The particle formed protects the diacyl peroxide from interacting with other ingredients and decomposing in the composition over time. This particle is formed by combining the diacyl peroxide with a "stabilizing additive" preferably selected from the group consisting of inorganic salts, antioxidants, chelants, binding agents, coating agents and mixtures thereof. The stabilizing additive should not dissolve the diacyl peroxide. The stabilizing additive in the particle is by weight of the particle from about 0.1% to about 95%, preferably from about 10% to about 95%, more preferably from about 40% to about 95% stabilizing additive.

Preferably, the stabilizing additive is not miscible with other components of the composition at temperatures at or below 100° F., preferably 120° F. In a particularly preferred embodiment the stabilizing agent would be soluble in the wash solution.

The inorganic salt, useful as a stabilizing additive include but are not limited to alkali metal sulfates, citric acid, and boric acid, and their salts, alkali metal carbonates, bicarbonates and silicates and mixtures thereof. Preferred inorganic salts are sodium sulfate and citric acid, which, because they are non-alkaline, prevent alkaline hydrolysis in product.

Binding agents and coating agents include but are not limited to certain water soluble polymers in which the diacyl peroxide does not dissolve, ethoxylated C16–C20 alcohols with sufficient ethoxylate groups to prevent dissolution of the diacyl peroxide, aliphatic fatty acids, aliphatic fatty alcohols, maltodextrins, dextrin, starch, gelatin, polyethylene glycols with melting points above 100° F., polyvinyl alcohol, and sorbitol. The polymers include polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982, incorporated herein by reference. Other suitable copolymers are modified polyacrylate copolymers as disclosed in U.S. Pat. Nos. 4,530,766, and 5,084,535, both incorporated herein by reference.

Transition metal chelants which can be employed are selected from the group consisting of polyacetate and polycarboxylate builders such as the sodium, potassium, lithium, ammonium and substituted ammonium salts of ethylenediamine tetraacetic acid, ethylenediamine disuccinic acid (especially the S,S- form), nitrilotriacetic acid, tartrate monosuccinic acid, tartrate disuccinic acid, oxydisuccinic acid, carboxymethyloxysuccinic acid, mellitic acid, sodium benzene polycarboxylate salts; nitrilotris (methylenephosphonic acid) diethylenetrinitrilopentakis (methylenephosphonic acid), 1-hydroxyethylidene-1,1-diphosphonic acid, other phosphonates chelants (e.g. Dequest line of products from Monsanto), ethylene-N,N'-bis(o-hydroxyphenylglycine), dipicolinic acid and mixtures thereof.

Antioxidants (radical trap, radical scavenger or free radical inhibitor) can also be suitable stabilizing additives. These compounds slow down or stop a reaction even though present in small amounts. In the present invention it is believed the antioxidant would trap or scavenge the radical formed due to thermal decomposition of the peroxide bond. This would prevent the radical from further reacting or propagating the formation of another radical (self-accelerated decomposition). Since this material would be used in small amounts in the particle, it most likely would not hurt overall performance of the ADD. Suitable antioxidants include but are not limited to citric acid, phosphoric acid, BHT, BHA, α-tocopherol, Irganox series C (Ciba Giegy), Tenox series (Kodax) and mixtures thereof.

As stated, many of the above listed stabilizing additives can also provide other benefits in the ADD product (i.e. pH control, carbonate/silicate dispersion) as well as serve as the stabilizing additive. These ingredients therefore may also be added separately from the particulate. For example, agglomerated forms of the present invention may employ aqueous solutions of the polyacrylates discussed herein above as liquid binders for making the agglomerate.

The diacyl peroxide particles formed preferably have a mean particle size from about 400 μm to about 1000 μm, more preferably from about 600 μm to about 800 μm with less than 1% of the diacyl peroxide particle population being greater than 1180 μm (Tyler 14 mesh) and less than 1% less than or equal to 212 μm (Tyler 65 mesh). The compositions of the present invention comprise by weight of the composition from about 0.1% to about 30%, preferably from about 1% to about 15%, more preferably from about 1.5% to about 10% of diacyl peroxide particle.

pH-Adjusting Control/Detergency Builder Components

The compositions herein have a pH of at least 7; therefore the compositions can comprise a pH-adjusting detergency builder component selected from water-soluble alkaline inorganic salts and water-soluble organic or inorganic builders. It has been discovered that to secure the benefits of the invention, the peroxide bleaching component must at least be combined with a pH-adjusting component which delivers a wash solution pH of from 7 to about 13, preferably from about 8 to about 12, more preferably from about 8 to about 11.0. The pH-adjusting component are selected so that when the ADD is dissolved in water at a concentration of 2000–6000 ppm, the pH remains in the ranges discussed above. The preferred non phosphate pH-adjusting component embodiments of the invention is selected from the group consisting of (i) sodium/potassium carbonate or sesquicarbonate (ii) sodium/potassium citrate (iii) citric acid (iv) sodium/potassium bicarbonate (v) sodium/potassium borate, preferably borax (vi) sodium/potassium hydroxide;

(vii) sodium/potassium silicate and (viii) mixtures of (i)–(vii).

Illustrative of highly preferred pH-adjusting component systems are binary mixtures of granular sodium titrate dihyrate with anhydrous sodium carbonate, and three-component mixtures of granular sodium titrate dihydrate, sodium carbonate and sodium disilicate.

The amount of the pH adjusting component in the instant ADD compositions is generally from about 0.9% to about 99%, preferably from about 5% to about 70%, more preferably from about 20% to about 60% by weight of the composition.

The essential pH-adjusting system can be complemented (i.e. for improved sequestration in hard water) by other optional detergency builder salts selected from phosphate or nonphosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S- form); nitrilotriacetic acid, tartrate monosuccinic acid, tartrate disuccinic acid, oxydiacetic acid, oxydisuccinic acid, carboxymethyloxysuccinic acid, mellitic acid, and sodium benzene polycarboxylate salts.

The detergency builders used to form the base granules can be any of the detergency builders known in the art, which include the various water-soluble, alkali metal, ammonium or substituted ammonium phosphates, polyphosphates, phosphonates, polyphosphonates, carbonates, borates, polyhydroxysulfonates, polyacetates, carboxylates (e.g. citrates), aluminosilicates and polycarboxylates. Preferred are the alkali metal, especially sodium, salts of the above and mixtures thereof.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137, 3,400,176 and 3,400,148, incorporated herein by reference.

Non-phosphate detergency builders include but are not limited to the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S- form); nitrilotriacetic acid, tartrate monosuccinic acid, tartrate disuccinic acid, oxydisuccinic acid, carboxymethyloxysuccinic acid, mellitic acid, and sodium benzene polycarboxylate salts.

In general, pH values of the instant compositions can vary during the course of the wash as a result of the water and soil present. The best procedure for determining whether a given composition has the herein-indicated pH values is as follows: prepare an aqueous solution or dispersion of all the ingredients of the composition by mixing them in finely divided form with the required amount of water to have a 3000 ppm total concentration. Do not have any coatings on the particles capable of inhibiting dissolution. (In the case of the second pH adjusting component it should be omitted from the formula when determining the formula's initial pH value). Measure the pH using a conventional glass electrode at ambient temperature, within about 2 minutes of forming the solution or dispersion. To be clear, this procedure relates to pH measurement and is not intended to be construed as limiting of the ADD compositions in any way; for example, it is clearly envisaged that fully-formulated embodiments of the instant ADD compositions may comprise a variety of ingredients applied as coatings to other ingredients.

Other Optional Bleaches

The ADD compositions of the present invention can additionally and preferably do contain an additional amount other bleaching sources.

For example oxygen bleach can be employed in an amount sufficient to provide from 0.01% to about 8%, preferably from about 0.1% to about 5.0%, more preferably from about 0.3% to about 4.0%, most preferably from about 0.8% to about 3% of available oxygen (AvO) by weight of the ADD.

Available oxygen of an ADD or a bleach component is the equivalent bleaching oxygen content thereof expressed as % oxygen. For example, commercially available sodium perborate monohydrate typically has an available oxygen content for bleaching purposes of about 15% (theory predicts a maximum of about 16%). Methods for determining available oxygen of a formula after manufacture share similar chemical principles but depend on whether the oxygen bleach incorporated therein is a simple hydrogen peroxide source such as sodium perborate or percarbonate, is an activated type (e.g., perborate with tetra-acetyl ethylenediamine) or comprises a performed peracid such as monoperphthalic acid. Analysis of peroxygen compounds is well-known in the art: see, for example, the publications of Swern, such as "Organic Peroxides", Vol. I, D. H. Swern, Editor; Wiley, New York, 1970, LC #72-84965, incorporated by reference. See for example the calculation of "percent active oxygen" at page 499. This term is equivalent to the terms "available oxygen" or "percent available oxygen" as used herein.

The peroxygen bleaching systems useful herein are those capable of yielding hydrogen peroxide in an aqueous liquor. These compounds include but are not limited to the alkali metal peroxides, organic peroxide bleaching compounds such as urea peroxide and inorganic persalt bleaching compounds such as the alkali metal perborates, percarbonates, perphosphates, and the like. Mixtures of two or more such bleaching compounds can also be used.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred because of environmental issues associated with boron. Many geographies are forcing legislation to eliminate elements such as boron from formulations.

Suitable oxygen-type bleaches are further described in U.S. Pat. No. 4,412,934 (Chung et al), issued Nov. 1, 1983, and peroxyacid bleaches described in European Patent Application 033,259. Sagel et al, published Sep. 13, 1989, both incorporated herein by reference, can be used.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include carbonate, sulfate, silicate, borosilicate, fatty carboxylic acids, and mixtures thereof.

An inorganic chlorine bleach ingredient such as chlorinated trisodium phosphate can be utilized, but organic chlorine bleaches such as the chlorocyanurates are preferred. Water-soluble dichlorocyanurates such as sodium or potassium dichloroisocyanurate dihydrate are particularly preferred.

Available chlorine of an ADD or a bleach component is the equivalent bleaching chlorine content thereof expressed as % equivalent $Cl_2$ by weight.

For the excellent bleaching results of the present invention which may contain the optional peroxygen bleach component the composition is formulated with an activator (peracid precursor). The activator is present at levels of from about 0.01% to about 15%, preferably from about 1% to about 10%, more preferably from about 1% to about 8%, by weight of the composition. Preferred activators are selected from the group consisting of benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzolyvalerolactam (BZVL), octanoyloxybenzenesulphonate ($C_8$-OBS), perhydrolyzable esters and mixtures thereof, most preferably benzoylcaprolactam and benzolyvalerolactam. Particularly preferred bleach activators in the pH range from about 8 to about 9.5 are those selected having an OBS or VL leaving group.

Preferred bleach activators are those described in U.S. Pat. No. 5,130,045, Mitchell et al, and U.S. Pat. No. 4,412,934, Chung et al, and copending patent applications U.S. Ser. Nos. 08/064,624, 08/064,623, 08/064,621, 08/064,562, 08/064,564, 08/082,270 and copending application to M. Burns, A. D. Willey, R. T. Hartshorn, C. K. Ghosh, entitled "Bleaching Compounds Comprising Peroxyacid Activators Used With Enzymes" and having U.S. Ser. No. 08/133,691 (P&G Case 4890R), all of which are incorporated herein by reference.

The mole ratio of peroxygen bleaching compound (as AvO) to bleach activator in the present invention generally ranges from at least 1:1, preferably from about 20:1 to about 1:1, more preferably from about 10:1 to about 3:1.

Quaternary substituted bleach activators may also be included. The present ADD compositions comprise a quaternary substituted bleach activator (QSBA) or a quaternary substituted peracid (QSP); more preferably, the former. Preferred QSBA structures are further described in copending U.S. Ser. No. 08/298,903, 08/298,650, 08/298,906 and 08/298,904 filed Aug. 31, 1994, incorporated herein by reference.

Bleach Catalyst

The bleach catalyst material which is an optional but preferable ingredient, can comprise the free acid form, the salts, and the like.

One type of bleach catalyst is a catalyst system comprising a transition metal cation of defined bleach catalytic activity, such as copper, iron, titanium, ruthenium tungsten, molybenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl- 1,4,7-triazacyclononane, 2-methyl-1,4,7-triazacyclononane, and mixtures thereof.

The bleach catalysts useful in machine dishwashing compositions and concentrated powder detergent compositions may also be selected as appropriate for the present invention. For examples of suitable bleach catalysts see U.S. Pat. No. 4,246,612 and U.S. Pat. No. 5,227,084.

See also U.S. Pat. No. 5,194,416 which teaches mononuclear manganese (IV) complexes such as Mn(1,4,7-trimethyl-1,4,7-triazacyclononane$(OCH_3)_3$-$(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

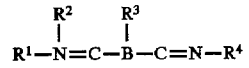

wherein $R^1$, $R^2$, $R^3$, and $R^4$ can each be selected from H, substituted alkyl and aryl groups such that each $R^1$—N=C—$R^2$ and $R^3$—C=N—$R^4$ form a five or six-membered ring. Said ring can further be substituted. B is a bridging group selected from O, S. $CR^5R^6$; $NR^7$ and C=O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]$-$(ClO_4)_3$.

The bleach catalysts of the present invention may also be prepared by combining a water-soluble ligand with a water-soluble manganese salt in aqueous media and concentrating the resulting mixture by evaporation. Any convenient water-soluble salt of manganese can be used herein. Manganese (II), (III), (IV) and/or (V) is readily available on a commercial scale. In some instances, sufficient manganese may be present in the wash liquor, but, in general, it is preferred to add Mn cations in the compositions to ensure its presence in catalytically-effective mounts. Thus, the sodium salt of the ligand and a member selected from the group consisting of $MnSO_4$, $Mn(ClO_4)_2$ or $MnCl_2$ (least preferred) are dissolved in water at molar ratios of ligand:Mn salt in the range of about 1:4 to 4:1 at neutral or slightly alkaline pH. The water may first be de-oxygenated by boiling and cooled by spraying with nitrogen. The resulting solution is evaporated (under $N_2$, if desired) and the resulting solids are used in the bleaching and detergent compositions herein without further purification.

In an alternate mode, the water-soluble manganese source, such as $MnSO_4$, is added to the bleach/cleaning composition or to the aqueous bleaching/cleaning bath which comprises the ligand. Some type of complex is apparently formed in situ, and improved bleach performance is secured. In such an in situ process, it is convenient to use a considerable molar excess of the ligand over the manganese, and mole ratios of ligand:Mn typically are 3:1 to 15:1. The additional ligand also serves to scavenge vagrant metal ions such as iron and copper, thereby protecting the bleach from decomposition. One possible such system is described in European patent application, publication no. 549,271.

While the structures of the bleach-catalyzing manganese complexes of the present invention have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn•ligand species which actually exists, it functions in an apparently catalytic manner to provide improved bleaching performances on stubborn stains such as tea, ketchup, coffee, wine, juice, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Silicates

The compositions of the type described herein optionally, but preferably comprise alkali metal silicates and/or metasilicates. The alkali metal silicates hereinafter described provide pH adjusting capability (as described above), protection against corrosion of metals and against attack on dishware, inhibition of corrosion to glasswares and chinawares. The $SiO_2$ level is from about 0.5% to about 20%, preferably from about 1% to about 15%, more preferably from about 2% to about 12%, most preferably from about 3% to about 10%, based on the weight of the ADD.

The ratio of $SiO_2$ to the alkali metal oxide ($M_2O$, where M=alkali metal) is typically from about 1 to about 3.2, preferably from about 1 to about 3, more preferably from about 1 to about 2.4. Preferably, the alkali metal silicate is hydrous, having from about 15% to about 25% water, more preferably, from about 17% to about 20%.

Anhydrous forms of the alkali metal silicates with a $SiO_2$:$M_2O$ ratio of 2.0 or more are also less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H20 and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Other suitable silicates include the crystalline layered sodium silicates have the general formula:

$$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably s. The most preferred material is —$Na_2Si_2O_5$, available from Hoechst AG as NaSKS-6.

The crystalline layered sodium silicate material is preferably present in granular detergent compositions as a particulate in intimate admixture with a solid, water-soluble ionisable material. The solid, water-soluble ionisable material is selected from organic acids, organic and inorganic acid salts and mixtures thereof.

Dispersant polymers

When present, a dispersant polymer in the instant ADD compositions is typically in the range from 0 to about 25%, preferably from about 0.5% to about 20%, more preferably from about 1% to about 7% by weight of the ADD composition. Dispersant polymers are also useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 1000 to about 250,000, and most preferably, especially if the ADD is for use in North American automatic dishwashing appliances, is from about 1000 to about 5,000.

Other suitable dispersant polymers include those disclosed in U.S. Pat. No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —$[(C(R^2)C(R^1)(C(O)OR^3)]$— wherein the incomplete valences inside the square braces are hydrogen and at least one of the substituents $R^1$, $R^2$ or $R^3$, preferably $R^1$ or $R^2$, is a 1 to 4 carbon alkyl or hydroxyalkyl group, $R^1$ or $R^2$ can be a hydrogen and $R^3$ can be a hydrogen or alkali metal salt. Most preferred is a substituted acrylic monomer wherein $R^1$ is methyl, $R^2$ is hydrogen and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of 3500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula $HO(CH_2CH_2O)_m(CH_2CH(CH_3)O)_n(CH(CH_3)CH_2O)OH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred cellulose-derived dispersant polymers are the carboxymethyl celluloses.

Yet another group of acceptable dispersants are the organic dispersant polymers, such as polyaspartate.

Low-Foaming Nonionic Surfactant

ADD compositions of the present invention can comprise low foaming nonionic surfactants (LFNIs). LFNI can be present in amounts from 0 to about 10% by weight, preferably from about 1% to about 8%, more preferably from about 0.25% to about 4%. LFNIs are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at temperatures below about 100° F., more preferably below about 120° F.

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described herein before include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available SLF18 from Olin Corp. and any biodegradable LFNI having the melting point properties discussed herein above.

Anionic Co-surfactant

The automatic dishwashing detergent compositions herein can additionally contain an anionic co-surfactant. When present, the anionic co-surfactant is typically in an amount from 0 to about 10%, preferably from about 0.1% to about 8%, more preferably from about 0.5% to about 5%, by weight of the ADD composition.

Suitable anionic co-surfactants include branched or linear alkyl sulfates and sulfonates. These may contain from about 8 to about 20 carbon atoms. Other anionic cosurfactants include the alkyl benzene sulfonates containing from about 6 to about 13 carbon atoms in the alkyl group, and mono- and/or dialkyl phenyl oxide mono- and/or di-sulfonates wherein the alkyl groups contain from about 6 to about 16 carbon atoms. All of these anionic co-surfactants are used as stable salts, preferably sodium and/or potassium.

Preferred anionic co-surfactants include sulfobetaines, betaines, alkyl(polyethoxy)sulfates (AES) and alkyl (polyethoxy)carboxylates which are usually high sudsing. Optional anionic co-surfactants are further illustrated in published British Patent Application No. 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference.

Preferred alkyl(polyethoxy)sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$ alcohol itself is preferable commercially available. $C_{12}$–$C_{15}$ alkyl sulfate which has been ethoxylated with from about 1 to about 5 moles of ethylene oxide per molecule is preferred. Where the compositions of the invention are formulated to have a pH of between 6.5 to 9.3, preferably between 8.0 to 9, wherein the pH is defined herein to be the pH of a 1% solution of the composition measured at 20° C., surprisingly robust soil removal, particularly proteolytic soil removal, is obtained when $C_{10}$–$C_{18}$ alkyl ethoxysulfate surfactant, with an average degree of ethoxylation of from 0.5 to 5 is incorporated into the composition in combination with a proteolytic enzyme, such as neutral or alkaline proteases at a level of active enzyme of from 0.005% to 2%. Preferred alkyl (polyethoxy)sulfate surfactants for inclusion in the present invention are the $C_{12}$–$C_{15}$ alkyl ethoxysulfate surfactants with an average degree of ethoxylation of from 1 to 5, preferably 2 to 4, most preferably 3.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Alkyl(polyethoxy)carboxylates suitable for use herein include those with the formula $RO(CH_2CH_2O)x$ $CH_2COO$—M wherein R is a $C_6$ to $C_{25}$ alkyl group, x ranges from 0 to 10, preferably chosen from alkali metal, alkaline earth metal, ammonium, mono-, di-, and tri-ethanolammonium, most preferably from sodium, potassium, ammonium and mixtures thereof with magnesium ions. The preferred alkyl(polyethoxy)carboxylates are those where R is a $C_{12}$ to $C_{18}$ alkyl group.

Highly preferred anionic cosurfactants herein are sodium or potassium salt-forms for which the corresponding calcium salt form has a low Kraft temperature, e.g., 30° C. or below, or, even better, 20° C. or lower. Examples of such highly preferred anionic cosurfactants are the alkyl (polyethoxy)sulfates.

The preferred anionic co-surfactants of the invention in combination with the other components of the composition provide excellent cleaning and outstanding performance from the standpoints of residual spotting and filming. However, many of these co-surfactants may also be high sudsing thereby requiring the addition of LFNI, LFNI in combination with alternate suds suppressors as further disclosed hereinafter, or alternate suds suppressors without conventional LFNI components.

Detersive Enzymes (including enzyme adjuncts)

The compositions of this invention may optionally, but preferably, contain from 0 to about 8%, preferably from about 0.001% to about 5%, more preferably from about 0.003% to about 4%, most preferably from about 0.005% to about 3%, by weight, of active detersive enzyme. The knowledgeable formulator will appreciate that different enzymes should be selected depending on the pH range of the ADD composition. Thus, Savinase® may be preferred in the instant compositions when formulated to deliver wash pH of 10, whereas Alcalase® may be preferred when the ADDs deliver wash pH of, say, 8 to 9. Moreover, the formulator will generally select enzyme variants with enhanced bleach compatibility when formulating oxygen bleaches containing compositions of the present invention.

In general, the preferred detersive enzyme herein is selected from the group consisting of proteases, amylases, lipases and mixtures thereof. Most preferred are proteases or amylases or mixtures thereof.

The proteolytic enzyme can be of animal, vegetable or microorganism (preferred) origin. More preferred is serine proteolytic enzyme of bacterial origin. Purified or nonpurified forms of enzyme may be used. Proteolytic enzymes produced by chemically or genetically modified mutants are included by definition, as are close structural enzyme variants. Particularly preferred by way of proteolytic enzyme is bacterial serine proteolytic enzyme obtained from Bacillus, Bacillus subtilis and/or Bacillus licheniformis. Suitable commercial proteolytic enzymes include Alcalase®, Esperase®, Durazym®, Savinase®, Maxatase®, Maxacal®, and Maxapem® 15 (protein engineered Maxacal); Purafect® and subtilisin BPN and BPN' are also commercially available. Preferred proteolytic enzymes also encompass modified bacterial serine proteases, such as those described in European Patent Application Ser. No. 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Most preferred is what is called herein "Protease C", which is a triple variant of an alkaline serine protease from Bacillus in which tyrosine replaced valine at position 104, serine replaced asparagine at position 123, and alanine replaced threonine at position 274. Protease C is described in EP 90915958:4, corresponding to WO 91/06637, Published May 16, 1991, which is incorporated herein by reference. Genetically modified variants, particularly of Protease C, are also included herein. Some preferred proteolytic enzymes are selected from the group consisting of Savinase®, Esperase®, Maxacal®, Purafect®, BPN', Protease A and Protease B, and mixtures thereof. Bacterial serine protease enzymes obtained from *Bacillus subtilis* and/or *Bacillus licheniformis* are preferred. An especially preferred protease herein referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76 in combination with one or more amino acid residue position equivalent to those selected from the group consisting of +99, +101, +103, +107 and +123 in Bacillus amyloliquefaciens subtilisin as described in the concurrently filed patent application of A. Baeck, C. K. Ghosh, P. P. Greycar, R. R. Bott and L. J. Wilson, entitled "Protease-Containing Cleaning Compositions" and having U.S. Ser. No. 08/136,797 (P&G Case 5040). This application is incorporated herein by reference.

Preferred lipase-containing compositions comprise from about 0.001 to about 0.01% lipase, from about 2% to about 5% amine oxide and from about 1% to about 3% low foaming nonionic surfactant.

Suitable lipases for use herein include those of bacterial, animal, and fungal origin, including those from chemically or genetically modified mutants. Suitable bacterial lipases include those produced by Pseudomonas, such as Pseudomonas stutzeri ATCC 19.154, as disclosed in British Patent 1,372,034, incorporated herein by reference. Suitable lipases include those which show a positive immunological cross-reaction with the antibody of the lipase produced from the microorganism Pseudomonas fluorescens IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with the Amano-P antibody, using the standard and well-known immunodiffusion procedure according to Oucheterlon (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex Pseudomonas fragi FERM P 1339 (available under the trade name Amano-B), lipase ex Pseudomonas nitroreducens var. lipolyticum FERM P 1338 (available under the trade name Amano-CES), lipases ex Chromobacter viscosum var. lipolyticum NRRlb 3673, and further Chromobacter viscosum lipases, and lipases ex Pseudomonas gladioli. A preferred lipase is derived from Pseudomonas pseudoalcaligenes, which is described in Granted European Patent, EP-B-0218272. Other lipases of interest are Amano AKG and Bacillis Sp lipase (e.g. Solvay enzymes). Additional lipases which are of interest where they are compatible with the composition are those described in EP A 0 339 681, published Nov. 28, 1990, EP A 0 385 401, published Sep. 5, 1990, EO A 0 218 272, published Apr. 15, 1987, and PCT/DK 88/00177, published May 18, 1989, all incorporated herein by reference.

Suitable fungal lipases include those produced by Humicola lanuginosa and Thermomyces lanuginosus. Most preferred is lipase obtained by cloning the gene from Humicola lanuginosa and expressing the gene in Aspergillus oryzae as described in European Patent Application 0 258 068, incorporated herein by reference, commercially available under the trade name LipolaseR from Novo-Nordisk.

Any amylase suitable for use in a dishwashing detergent composition can be used in these compositions. Amylases include for example, 2-amylases obtained from a special strain of B. licheniforms, described in more detail in British Patent Specification No. 1,296,839. Amylolytic enzymes include, for example, Rapidase™, Maxamyl™ , Termamyl™ and BAN™. In a preferred embodiment, from about 0.001% to about 5%, preferably 0.005% to about 3%, by weight of active amylase can be used. Preferably from about 0.005% to about 3% by weight of active protease can be used. Preferably the amylase is Maxamyl™ and/or Termamyl™ and the protease is Savinase® and/or protease B. As in the case of proteases, the formulator will use ordinary skill in selecting amylases or lipases which exhibit good activity within the pH range of the ADD composition.

Stability-Enhanced Amylase

Engineering of enzymes for improved stability, e.g., oxidative stability is known. See, for example J. Biological Chem., Vol. 260, No. 11, Jun. 1985, pp 6518–6521.

"Reference amylase" hereinafter refers to an amylase outside the scope of the amylase component of this invention and against which stability of an amylase within the invention can be measured.

The present invention also can makes use of amylases having improved stability in detergents, especially improved oxidative stability. A convenient absolute stability reference-point against which amylases used in the instant invention represent a measurable improvement is the stability of TERMAMYL (R) in commercial use in 1993 and available from Novo Nordisk A/S. This TERMAMYL (R) amylase is a "reference amylase". Amylases within the spirit and scope of the present invention share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which the amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the invention can be obtained from Novo Nordisk A/S, or from Genencor International.

Preferred amylases herein have the commonality of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B.licheniformis* alpha-amylase, known as TERMAMYL (R), or the homologous position variation of a similar parent amylase, such as *B. amyloliquefaciens, B.subtilis,* or *B.stearothermophilus;*

(b) Stability-enhanced amylases as described by Genencor International in a paper entitled "Oxidatively Resistant alpha-Amylases" presented at the 207th American Chemical Society National Meeting, March 13–17 1994, by C. Mitchinson. Therein it was noted that bleaches in automatic dishwashing detergents inactivate alpha-amylases but that improved oxidative stability amylases have been made by Genencor from *B.licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE (R) and SUNLIGHT(R);

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Enzyme Stabilizing System

The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger unions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is extremely incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in the solid-form ADD composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Silicone and Phosphate Ester Suds Suppressors

The ADDs of the invention can optionally contain an alkyl phosphate ester suds suppressor, a silicone suds suppressor, or combinations thereof. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADD for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressors.

Phosphate esters have also been asserted to provide some protection of silver and silver-plated utensil surfaces, however, the instant compositions can have excellent silvercare without a phosphate ester component. Without being limited by theory, it is believed that lower pH formulations, e.g., those having pH of 9.5 and below, plus the presence of the essential amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Corrosion Inhibitor

The present compositions may also contain corrosion inhibitor. Such corrosion inhibitors are preferred components of machine dishwashing compositions in accord with the invention, and are preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50: preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids, or their salts, especially aluminum tristearate. The $C_{12}$–$C_{20}$ hydroxy fatty acids, or their salts, are also suitable. Phosphonated octa-decane and other anti-oxidants such as betahydroxytoluene (BHT) are also suitable.

Other Optional Adjuncts

Depending on whether a greater or lesser degree of compactness is required, filler materials can also be present in the instant ADDs. These include sucrose, sucrose esters, sodium chloride, sodium sulfate, potassium chloride, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates in magnesium-salt form. Note that preferences, in terms of purity sufficient to avoid decomposing bleach, applies also to builder ingredients.

Hydrotrope materials such as sodium benzene sulfonate, sodium toluene sulfonate, sodium cumene sulfonate, etc., can be present in minor amounts.

Bleach-stable perfumes (stable as to odor); and bleach-stable dyes (such as those disclosed in U.S. Pat. No. 4,714,562, Roselle et al, issued Dec. 22, 1987); can also be added to the present compositions in appropriate amounts. Other common detergent ingredients are not excluded.

Since certain ADD compositions herein can contain water-sensitive ingredients, e.g., in embodiments comprising anhydrous amine oxides or anhydrous citric acid, it is desirable to keep the free moisture content of the ADDs at a minimum, e.g., 7% or less, preferably 4% or less of the ADD; and to provide packaging which is substantially impermeable to water and carbon dioxide. Plastic bottles, including refillable or recyclable types, as well as conventional barrier cartons or boxes are generally suitable. When ingredients are not highly compatible, e.g., mixtures of silicates and citric acid, it may further be desirable to coat at least one such ingredient with a low-foaming nonionic surfactant for protection. There are numerous waxy materials which can readily be used to form suitable coated particles of any such otherwise incompatible components.

Method for Cleaning

The present invention also encompasses methods for cleaning soiled tableware, especially plastic ware. A preferred method comprises contacting the tableware with a pH wash aqueous medium of at least 8. The aqueous medium comprising at least about 1% diacyl peroxide. The diacyl peroxide is added in a stabilized particle form.

A preferred method for cleaning soiled tableware comprises using the diacyl peroxide particle, enzyme, low foaming surfactant and detergency builder. The aqueous medium is formed by dissolving a solid-form automatic dishwashing detergent in an automatic dishwashing machine. A particularly preferred method also includes low levels of silicate, preferably from about 3% to about 10% $SiO_2$.

Process for Preparing Diacyl Peroxide Particles

A variety of methods may be employed to prepare the diacyl peroxide particles. Conventional methods of agitating, mixing, agglomerating and coating particulate components are well-known to those skilled in the art.

For examples, in one embodiment the water-insoluble diacyl peroxide is provided in a solid form and intimately mixed with a redox stable inorganic salt, such as sodium sulfate. To this mixture are added other stabilizing additives by liquid spray-on in any of a variety of conventional liquid-to-solids contacting equipment to provide an agglomerated particle with a size suitable for mixing into a granular ADD and preventing segregation of the particle within the composition. If the stabilizing additives are used as aqueous solutions or dispersions, then excess water is dried off using conventional drying equipment. Liquid-to-solids contacting, and drying can be done in the same equipment or in two separate steps depending on the specific application.

Chelants and/or antioxidants can be added as solids to the dry mix of the diacyl peroxide and the redox stable inorganic salt formed above, or as liquids along with the liquid binder used to agglomerate the particles of the dry mix.

In a preferred embodiment, the agglomerated particle described above is further coated with a material in which the diacyl peroxide does not dissolve under particle processing and/or product storage conditions. Preferred materials are water soluble. Particularly preferred materials are also non-aqueous, have a melting point below that of the diacyl peroxide, preferably between about 100° F. and about 160° F., most preferably between about 120° F. and about 140° F. and are not miscible at temperatures up to 100° F., preferably to 120° F. with the LFNI in the final granular ADD composition.

In another embodiment the water-insoluble solid-form diacyl peroxide is provided with a very fine particle size (preferably less than 300 μm, more preferably less than 150 μm). If this is not the size achieved in the basic production process, then this size can be achieved through grinding, either in the wet or dry state. This can be done before addition of a redox stable inorganic salt, or preferably as a dry mix with an inorganic salt. Reduction of the particle size, while making the stabilization challenge even greater helps keep the diacyl peroxide from remaining as residue after the dishwashing process.

In an alternate method, a mixture of the diacyl peroxide and a redox-stable inorganic salt and other optional stabilizing additives are co extruded with a stabilizing binder in which the diacyl peroxide does not dissolve to provide an extrudate. The extrudate shape reduces the surface area for interaction with incompatible materials in the ADD composition as compared to a roughly spherical agglomerate. The stabilizing binder would most preferably have the same properties as described above.

In yet another alternate method, the water insoluble diacyl peroxide (e.g. dibenzoyl peroxide) is provided as an aqueous suspension, or mixed into an aqueous solution of a binding agent (e.g.. Acusol 445N). This mixture is then combined with an inorganic salt, to form a granulated particle. Excess water is dried off using conventional drying equipment. This particulate is then coated as described above.

In still another method, the water insoluble diacyl peroxide is mixed in with a non-aqueous coating agent in which the diacyl peroxide is not soluble to form a paste. It is particularly preferred when the non-aqueous coating agent has a melting point above 120° F. The hot paste (kept above the melting point of the coating agent) is then combined with an inorganic salt and cooled to form a particle. A variety of granulation techniques can be used to intimately mix the paste and the inorganic salt, including, but not limited to agglomeration, coating, extrusion, and flaking. By embedding the diacyl peroxide within the coating agent, deleterious interactions with incompatible components in the final product can be avoided.

The following examples illustrate the compositions of the present invention. These examples are not meant to limit or otherwise define the scope of the invention. All parts, percentages and ratios used herein are expressed as percent weight unless otherwise specified.

EXAMPLE I

Granular automatic dishwashing detergent wherein plasticware stain removal benefits are achieved as follows:

TABLE 1

| Ingredients | % by weight A | B | C |
|---|---|---|---|
| Sodium Citrate (as anhydrous) | 29.00 | 15.00 | 15.00 |
| Acusol 480N[1] (as active) | 6.00 | 6.00 | 6.00 |
| Sodium carbonate | — | — | 20.00 |
| Britesil H2O (as $SiO_2$) | 17.00 | 8.00 | 8.00 |
| 1-hydroxyethylidene-1, 1-diphosphonic acid | 0.50 | 0.50 | 0.50 |
| Nonionic surfactant[2] | — | 2.00 | — |
| Nonionic surfactant[3] | 1.50 | — | 1.50 |
| Savinase 12T | 2.20 | 2.00 | 2.20 |
| Termamyl 60T | 1.50 | 1.00 | 1.50 |
| Perborate monohydrate (as AvO) | 0.30 | 1.50 | 0.30 |
| Perborate tetrahydrate (as AvO) | 0.90 | — | 0.90 |
| Diacyl Peroxide Particulate[3] | 6.70 | 2.70 | 2.70 |
| TAED | — | — | 3.00 |
| Diethylene triamine penta methylene phosphonic acid | 0.13 | — | 0.13 |
| Paraffin | 0.50 | — | 0.50 |
| Benzotriazole | 0.30 | — | 0.30 |
| Sulfate, water, etc. | | balance | |

[1]Dispersant from Rohm and Haas
[2]Poly Tergent SLF-18 surfactant from Olin Corporation
[3]Purafac LF404 surfactant from BASF.
[4]Diacyl Peroxide Particulate has 30% dibenzoyl peroxide, 40% sodium sulfate, 5% Acusol 480N polymer active, 2% maltodextrin, 12% ethoxylated stearyl alcohol, and balance water.

EXAMPLE II

Granular automatic dishwashing detergent wherein increased levels of plasticware stain removal benefits are achieved as follows:

TABLE 2

| Ingredients | % by weight D | E | F |
|---|---|---|---|
| Sodium Citrate (as anhydrous) | 15.00 | 15.00 | 15.00 |
| Acusol 480N[1] (active) | 6.00 | 6.00 | 6.00 |
| Sodium carbonate | 20.00 | 20.00 | 20.00 |
| Britesil H2O (as $SiO_2$) | 8.00 | 8.00 | 8.00 |
| 1-hydroxyethylidene-1, 1-diphosphonic acid | 0.50 | 0.50 | 0.50 |
| Nonionic surfactant[2] | 2.00 | 2.00 | 2.00 |
| Savinase 12T | 2.00 | 2.00 | 2.00 |
| Termamyl 60T | 1.00 | 1.00 | 1.00 |
| Perborate monohydrate (as AvO) | 1.50 | 1.50 | 1.50 |
| Diacyl Peroxide Particulate[3] | 2.00 | 4.00 | 6.00 |
| TAED | — | — | — |
| Sulfate, water, etc. | | balance | |

[1]Dispersant from Rohm and Haas
[2]Polytergent SLF-18 surfactant from Olin Corporation
[3]Diacyl Peroxide Particulate has 30% dibenzoyl peroxide, 45% sodium sulfate, 5% Acusol 480N polymer active, 10% polyethylene glycol (4000 M.W.), and balance water.

EXAMPLE III

Granular automatic dishwashing detergent wherein plasticware stain removal benefits are achieved with different diacyl peroxide particulates as follows:

TABLE 3

| Ingredients | % by weight G | H | I |
|---|---|---|---|
| Sodium Citrate (as anhydrous) | 20.00 | 20.00 | 20.00 |
| Acusol 480N[1] | 5.00 | 5.00 | 5.00 |
| Sodium carbonate | 15.00 | 15.00 | 15.00 |
| Britesil H2O (as $SiO_2$) | 6.00 | 6.00 | 6.00 |
| $Na_3$HEDDS | 0.20 | 0.20 | 0.20 |
| Nonionic surfactant[2] | 1.50 | 1.50 | 1.50 |
| FN3 | 1.00 | 1.00 | 1.00 |
| LE17 | 1.00 | 1.00 | 1.00 |
| Perborate monohydrate (as AvO) | 2.00 | 2.00 | 2.00 |
| Diacyl Peroxide Particulate | 6.70[3] | 6.70[4] | 6.70[5] |
| Sulfate, water, etc. | | balance | |

[1]Dispersant from Rohm and Haas
[2]Polytergent SLF-18 surfactant from Olin Corporation
[3]Diacyl Peroxide Particulate has 30% dibenzoyl peroxide with a mean particle diameter 500 μm, 40% sulfate, 2% HEDP, 5% Acusol 445N polymer active, 10% polyethylene glycol (4000 M.W.), 2% palmitic acid, and balance water.
[4]Diacyl Peroxide Particulate has 30% dibenzoyl peroxide with a mean particle diameter 100 μm, 40% sulfate, 2% HEDP, 5% Acusol 445N polymer, 10% polyethylene glycol (4000 M.W.), 2% palmitic acid, and balance water.
[5]Diacyl Peroxide Particulate has 30% dibenzoyl peroxide with a mean particle diameter 50 μm, 40% sulfate, 2% HEDP, 5% Acusol 445N polymer active, 10% polyethylene glycol (4000 M.W.), 2% palmitic acid, and balance water.

EXAMPLE IV

Granular automatic dishwashing detergent where plasticware stain removal benefits are achieved with different diacyl peroxide particulates as follows:

TABLE 4

| Ingredients | % by weight J | K | L |
|---|---|---|---|
| Sodium Citrate (as anhydrous) | 15.00 | 15.00 | 15.00 |
| Acusol 480N[1] (active) | 6.00 | 6.00 | 6.00 |
| Sodium carbonate | 20.00 | 20.00 | 20.00 |
| Britesil H2O (as $SiO_2$) | 8.00 | 8.00 | 8.00 |
| 1-hydroxyethylidene-1, 1-diphosphonic acid | 0.50 | 0.50 | 0.50 |
| Nonionic surfactant[2] | 2.00 | 2.00 | 2.00 |
| Savinase 12T | 2.00 | 2.00 | 2.00 |
| Termamyl 60T | 1.00 | 1.00 | 1.00 |
| Perborate monohydrate (as AvO) | 1.50 | 1.50 | 1.50 |
| Diacyl Peroxide Particulate | 5.00[3] | 5.00[4] | 5.00[5] |
| TAED | — | — | — |
| Sulfate, water, etc. | | balance | |

[1]Dispersant from Rohm and Haas
[2]Polytergent SLF-18 surfactant from Olin Corporation
[3]Diacyl Peroxide Particulate has 30% dibenzoyl peroxide with a mean particle size 150 μm, 40% sodium sulfate, 1% EDDS, 5% Acusol 980N (active), 10% PEG 4000, 2% palmitic acid, and balance water.
[4]Diacyl Peroxide Particulate has 30% dibenzoyl peroxide with a mean particle size 150 μm, 40% sodium citrate dihydrate, 1% EDDS, 8% maltodextrin, 10% PEG 4000, and balance water.
[5]Diacyl Peroxide Particulate has 30% dibenzoyl peroxide with a mean particle size 150 μm, 40% sodium sulfate, 1% EDDS, 0.1% BHT, 8% maltodextrin, 10% PEG 4000, and balance water.

EXAMPLE V

Granular detergent compositions containing diacyl peroxide and chlorine bleach are as follows:

TABLE 5

| | % by weight M |
|---|---|
| Sodium TripolyPhosphate (anhydrous basis) | 29.68 |
| Nonionic Surfactant | 2.50 |
| MSAP Suds Suppressor | 0.08 |
| Sodium Carbonate | 23.00 |
| Sodium Silicate (2.4r, as SiO2) | 6.50 |
| NaDCC Bleach (as AvCl2) | 1.10 |
| Sodium Sulfate | 21.79 |
| Dibenzoyl Peroxide (% active) | 0.80 |
| Perfume | 0.14 |

EXAMPLE VI

Granular automatic dishwashing detergent where plasticware stain removal benefits are achieved with different diacyl peroxide particulates as follows:

TABLE 6

| Ingredients | % by weight N | O | P |
|---|---|---|---|
| Sodium Citrate (as anhydrous) | 10.00 | 15.00 | 20.00 |
| Acusol 480N[1] (active) | 6.00 | 6.00 | 6.00 |
| Sodium carbonate | 15.00 | 10.00 | 5.00 |
| Sodium tripolyphosphate | 10.00 | 10.00 | 10.00 |
| Britesil H2O (as $SiO_2$) | 8.00 | 8.00 | 8.00 |
| 1-hydroxyethylidene-1, 1-diphosphonic acid | 0.50 | 0.50 | 0.50 |
| Nonionic surfactant[2] | 2.00 | 2.00 | 2.00 |
| Savinase 12T | 2.00 | 2.00 | 2.00 |
| Termamyl 60T | 1.00 | 1.00 | 1.00 |
| Perborate monohydrate (as AvO) | 1.50 | 1.50 | 1.50 |
| Diacyl Peroxide Particulate | 5.00[3] | 5.00[4] | 5.00[5] |
| TAED | — | — | — |
| Sulfate, water, etc. | | balance | |

[1]Dispersant from Rohm and Haas
[2]Polytergent SLF-18 surfactant from Olin Corporation
[3]Diacyl Peroxide Particulate has 30% dibenzoyl peroxide with a mean particle size 150 μm, 40% sodium sulfate, 1% EDDS, 5% Acusol 980N (active), 10% PEG 4000, 2% palmitic acid, and balance water.
[4]Diacyl Peroxide Particulate has 30% dibenzoyl peroxide with a mean particle size 150 μm, 40% sodium citrate dihydrate, 1% EDDS, 8% maltodextrin, 10% PEG 4000, and balance water.
[5]Diacyl Peroxide Particulate has 30% dibenzoyl peroxide with a mean particle size 150 μm, 40% sodium sulfate, 1% EDDS, 0.1% BHT, 8% maltodextrin, 10% PEG 4000, and balance water.

What is claimed is:

1. An automatic dishwashing detergent composition in granular or powder form, which composition comprises:

I) from about 1% to about 15% by weight of compositon of diacyl peroxide-containing particles which consist essentially of an admixture of:

A) from about 1% to about 80% by weight of particle of a water-insoluble diacyl peroxide selected from the group consisting of dibenzoyl peroxide, benzoyl glutaryl peroxide, benzoyl succinyl peroxide, di-(2-methybenzoyl) peroxide, diphthaloyl peroxide and mixtures thereof, and B) from about 0.1% to 95% by weight of particle of a watersoluble stabilizing additive in which the diacyl peroxide does not dissolve and which is selected from the group consisting of alkali metal sulfates and citrates, ethoxylated $C_{16-20}$ alcohols, polyethylene glycols melting above 100° F., maltodextrins, polyacrylate polymers and copolymers of molecular weight between 1000 and 80,000, ethylene diamine tetra-acetates, ethylene diamine disuccinates and mixtures of these stabilizing additives;

II) from about 0.1% to 10% by weight of the composition of a low foaming nonionic surfactant;

III) from about 5% to 70% by weight of the composition of a pH adjusting agent or builder component selected from the group consisting of alkali metal, ammonium and substituted ammonium phosphates, polyphosphates, phosphonates, polyphosphonates, carbonates, bicarbonates, borates, hydroxides, polyacetates, carboxylates, polycarboxylates, silicates, aluminosilicates and mixtures of these pH adjusting agent or builder components;

IV) from about 0.1% to 5.0% by weight of the composition of a chlorine bleach or additional peroxygen bleach; and V) from about 0.001% to 5% by weight of the composition of a detersive enzyme;

said composition providing a wash solution pH of from about 9 to 12.

2. A composition according to claim 1 wherein the diacyl peroxide is dibenzoyl peroxide.

3. A composition according to claim 2 wherein the dibenzoyl peroxide-containing particles have a mean particle size of from about 600 to 800 microns and the dibenzoyl peroxide used to form such particles has a mean particle size less than about 150 microns.

4. A composition according to claim 3 which additionally contains a bleach activator selected from the group consisting of nonanoyloxybenzene sulfonate (NOBS), benzoylcaprolactam, benzoylvalerolactam, tetraacetyl ethylenediamine (TAED) and mixtures thereof.

5. A composition according to claim 3 which contains from about 3% to about 10% by weight of silicate.

6. A composition according to claim 3 which contains from about 0.005% to about 3% by weight of protease or amylase.

7. A composition according to claim 3 further comprising from about 0.001% to about 5.0% by weight of the composition of a silicone or alkyl phosphate ester suds suppressor.

8. A composition according to claim 1 wherein said diacyl peroxide is diphthaloyl peroxide.

* * * * *